US006971904B2

(12) United States Patent
Wallmeier

(10) Patent No.: US 6,971,904 B2
(45) Date of Patent: Dec. 6, 2005

(54) LIGHT BULB SOCKET FOR MOTOR VEHICLE LAMPS

(75) Inventor: Wilhlem Friederich Wallmeier, Lippstadt (DE)

(73) Assignee: Bernhard Juergenhake Gesellschaft fuer Kabelkonfektion und Metallverarbeitung mbH, Lippstadt (DE)

( * ) Notice: Subject to any disclaimer, the term of this patent is extended or adjusted under 35 U.S.C. 154(b) by 0 days.

(21) Appl. No.: 10/972,423

(22) Filed: Oct. 26, 2004

(65) Prior Publication Data

US 2005/0095895 A1 May 5, 2005

(30) Foreign Application Priority Data

Oct. 30, 2003 (DE) ..... 203 16 669

(51) Int. Cl.[7] ..... H01R 4/24

(52) U.S. Cl. ..... 439/419; 439/417

(58) Field of Search ..... 439/404, 414, 439/419, 417, 336, 602, 699.1, 699.2, 854

(56) References Cited

U.S. PATENT DOCUMENTS

| | | | | |
|---|---|---|---|---|
| 3,800,267 | A | 3/1974 | Burgess et al. | |
| 5,630,729 | A * | 5/1997 | Francis | 439/548 |
| 6,086,408 | A * | 7/2000 | Tanigawa | 439/419 |
| 6,520,790 | B2 * | 2/2003 | Okamoto | 439/336 |
| 2003/0077933 | A1 * | 4/2003 | Tashiro et al. | 439/404 |

FOREIGN PATENT DOCUMENTS

| | | | |
|---|---|---|---|
| AU | 26511/77 | A | 6/1977 |
| DE | 35 32 205 | C1 | 2/1987 |
| DE | 44 39 701 | A1 | 5/1996 |
| DE | 196 03 374 | C2 | 8/1997 |

* cited by examiner

*Primary Examiner*—Tho D. Ta
(74) *Attorney, Agent, or Firm*—Birch, Stewart, Kolasch & Birch, LLP

(57) ABSTRACT

A light bulb socket for a motor vehicle lamp has a hull-shaped socket body formed of a cylindrically-shaped part and a separate plate for receiving contact springs. For stabilizing a seating of the contact springs, the plate has rearwardly directed protrusions that snugly enclose cross-sectional U-shaped end portions of the contact springs. Legs of the U-shaped end portions of the contact springs form a double contact bond to power lead cables with insulation-displacement connections.

13 Claims, 4 Drawing Sheets

LIGHT BULB SOCKET FOR MOTOR VEHICLE LAMPS

BACKGROUND OF THE INVENTION

This application claims a priority based on German Gebrauchsmuster Nr. 203 16 669.8, filed Oct. 30, 2003.

This invention concerns light bulb sockets for holding light bulbs, such as incandescent light bulbs, of motor-vehicle lamps of a type formed of a hull-shaped socket body of resinous plastic having a transverse partition into which contact springs can be shoved from a bulb side for snap-locking engagement.

In known sockets of this type, for example as taught in U.S. Pat. No. 3,800,267 and in Australian patent application 26517/77, a contact-spring-receiving, transverse, partition is constructed as one piece with a cylindrical sleeve body. Such a structure indeed has the generally well-known advantages of one-piece construction, however it has the disadvantage that contact springs can only be shoved with difficulty and laboriously into the transverse partition that is arranged deep in the cylindrical body. When bulb-contacting end portions of the contact springs are extremely bowed or bent they must be shoved in from the bulb-operational side and threaded through the quite deeply-located partition. Such a mounting of the contact springs, or elements, is difficult and requires a great deal of play between the contact springs and receiving openings in the partition. A connection between the contact springs and power-supply cables is limited to use of plug connectors because a space in the hull-shaped socket body is normally too small to accomplish an insulation-displacement (or insulation-piercing) clamping connection, IDC, therefor after the contact springs are placed in the partition.

It is therefore an object of this invention to make easier a mounting of contact springs in a supporting partition of a socket body and to construct the socket body so that neither shape nor size of a cylindrical part thereof is an undue hindrance to mounting extremely bent or bowed contact springs in the socket body.

BRIEF DESCRIPTION OF THE INVENTION

According to principles of this invention, a transverse partition of a light bulb socket is formed as a separate plate that is placed in a cylindrically-formed part of the light bulb socket from a rear end thereof to be fixedly engaged with the cylindrical-formed part by adhesive, welding and/or snap locking.

Such an arrangement of the socket body provides, in addition to an easier mounting of contact springs in their supporting partition, the plate, but also an easier contact bonding, or coupling, between the contact springs and power-supply cables, because this bonding can be accomplished outside the cylindrically-shaped part of the socket part. All of these improvements make possible, above all, an automation of the assembly of the socket body with contact springs and the contact coupling, or bonding, between the contact springs and the power-supply cables.

In a preferred embodiment of the invention, the contact-supporting plate is placed deeply in the cylindrically-formed part of the socket body to be substantially spaced from a rear end edge thereof. In this manner a protective collar-shaped rim portion is created for protecting the contact bonds between the contact springs and the power-supply cables against bumps, and therefore against power breaks.

A further benefit is provided by the power-supply cables extending perpendicular to a length-wise axis of the socket body, and by their bonding, or coupling, to the contact springs being accomplished by insulation-displacement clamp connection, IDC, technology. Such a contact bonding provides a surer power-supply coupling and can be accomplished quickly and easily.

In order to provide the insulation-displacement clamp contact bonds with tension relief, open slits extend to the free rear end edge of the collar-shaped rim portion surrounding the contact bonds in which the power-supply cables are clamped.

A further beneficial embodiment of the invention is achieved by the contact springs having U-shaped forms in cross section in areas at which they are held by the plate and in areas at which the insulation-displacement, IDC, slits for the bonds with the power-supply cables are arranged. In this manner, for one thing, securer seatings for the contact springs are formed in the plate and, for another thing, insulation-displacement connections, per power-supply cable and contact spring, are doubled, which is beneficial for secure establishment of good power-supply connections and mechanical strength of the bonds.

Mechanical strength as well as reduction of movement play between the contact springs and their supporting plate is improved by providing the plate with block-shaped protrusions extending toward a socket-rear end in which grooves are formed for receiving leg edges of the cross-sectional-U-shaped contact spring portions.

For further increasing contact reliability between contact springs and power-supply cables and for a water-proof closing of the rear end of the bulb socket, a bowel space defined by the plate and a rear end portion of the cylindrical portion of the socket body is filled with a bonding agent.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages will be apparent from the following more particular description of preferred embodiments of the invention, as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE INVENTION

Figure 1:
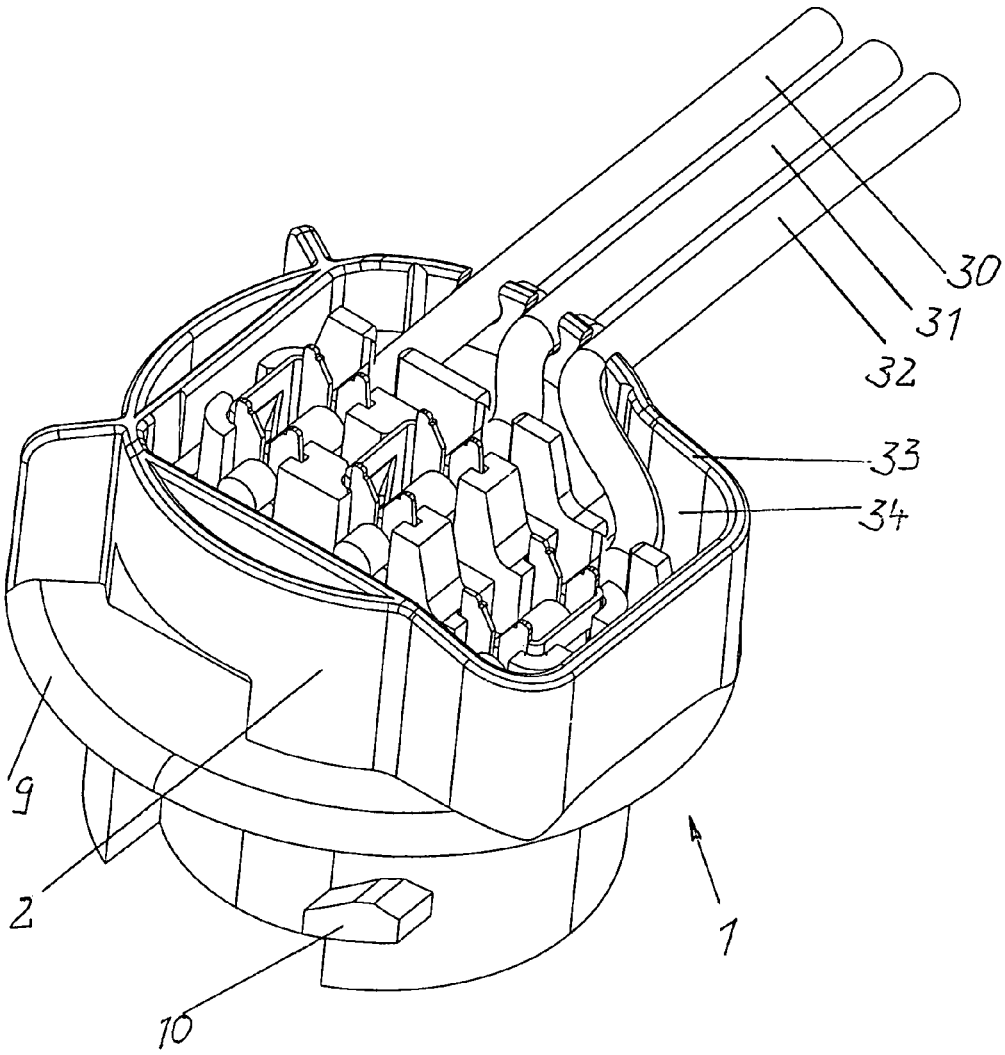
FIG. 1 is an isometric view of a rear end of a bulb socket of this invention with power supply cables connected thereto.
Figure 2:
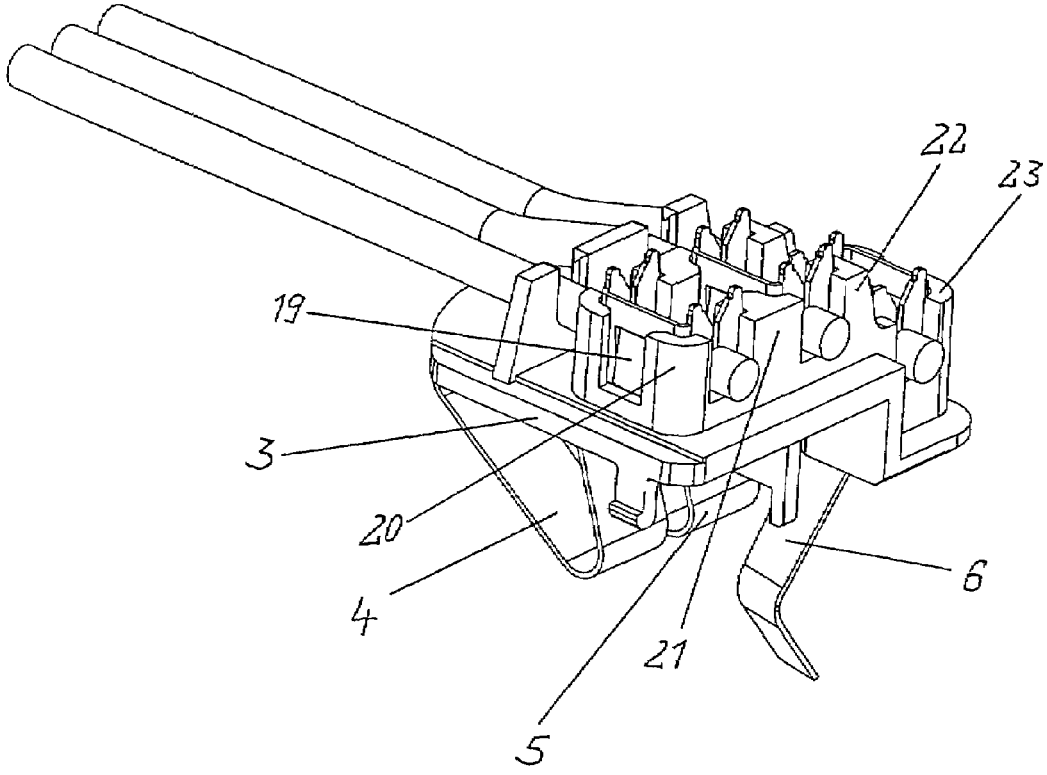
FIG. 2 is an isometric view of a rear side of a plate of the bulb socket of FIG. 1, with contact springs engaged therein and with the power supply cables bonded, that is clamped, in the contact springs.
Figure 3:
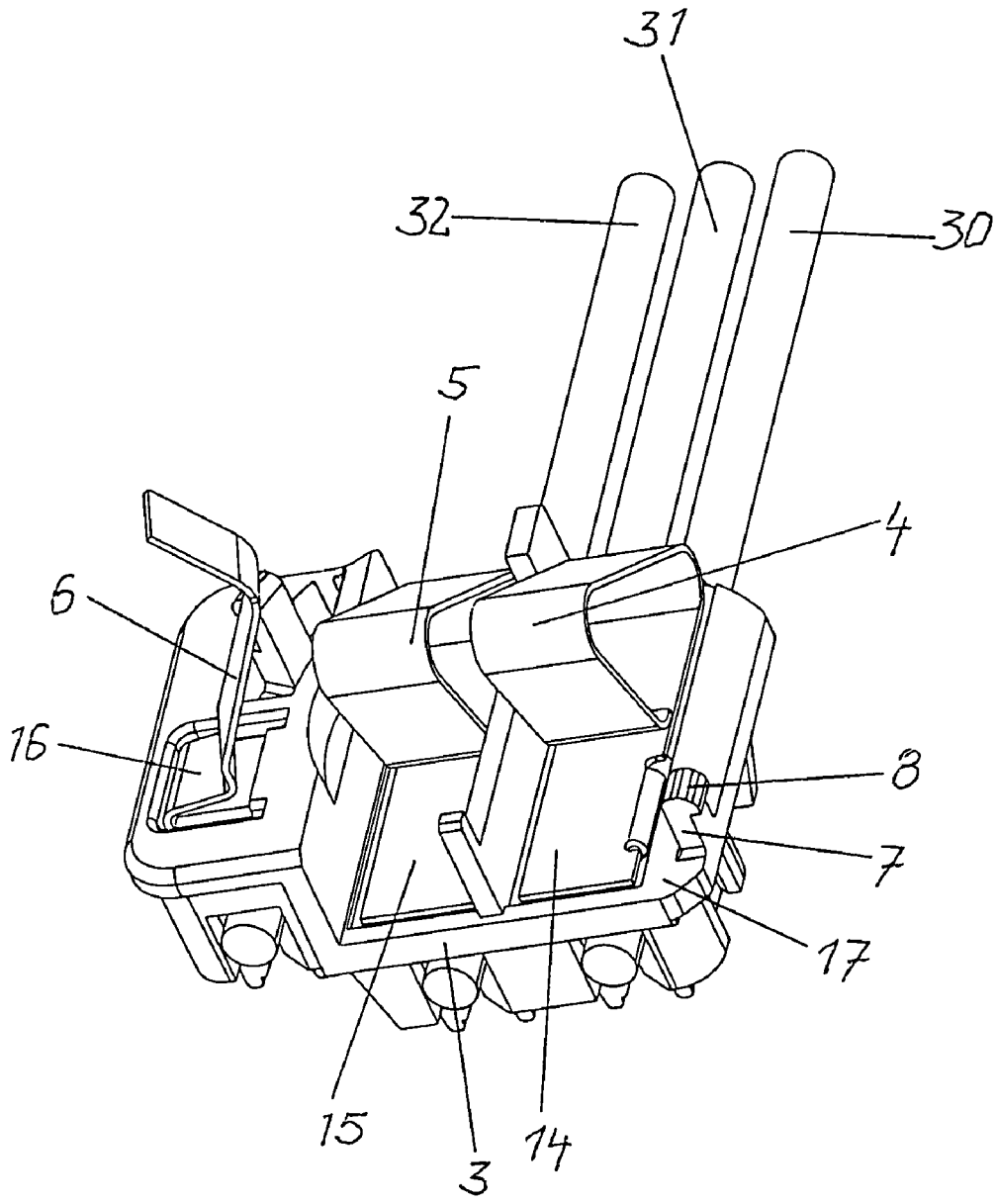
FIG. 3 is an isometric view of a front side, a bulb side, of the structure of FIG. 2.
Figure 4:
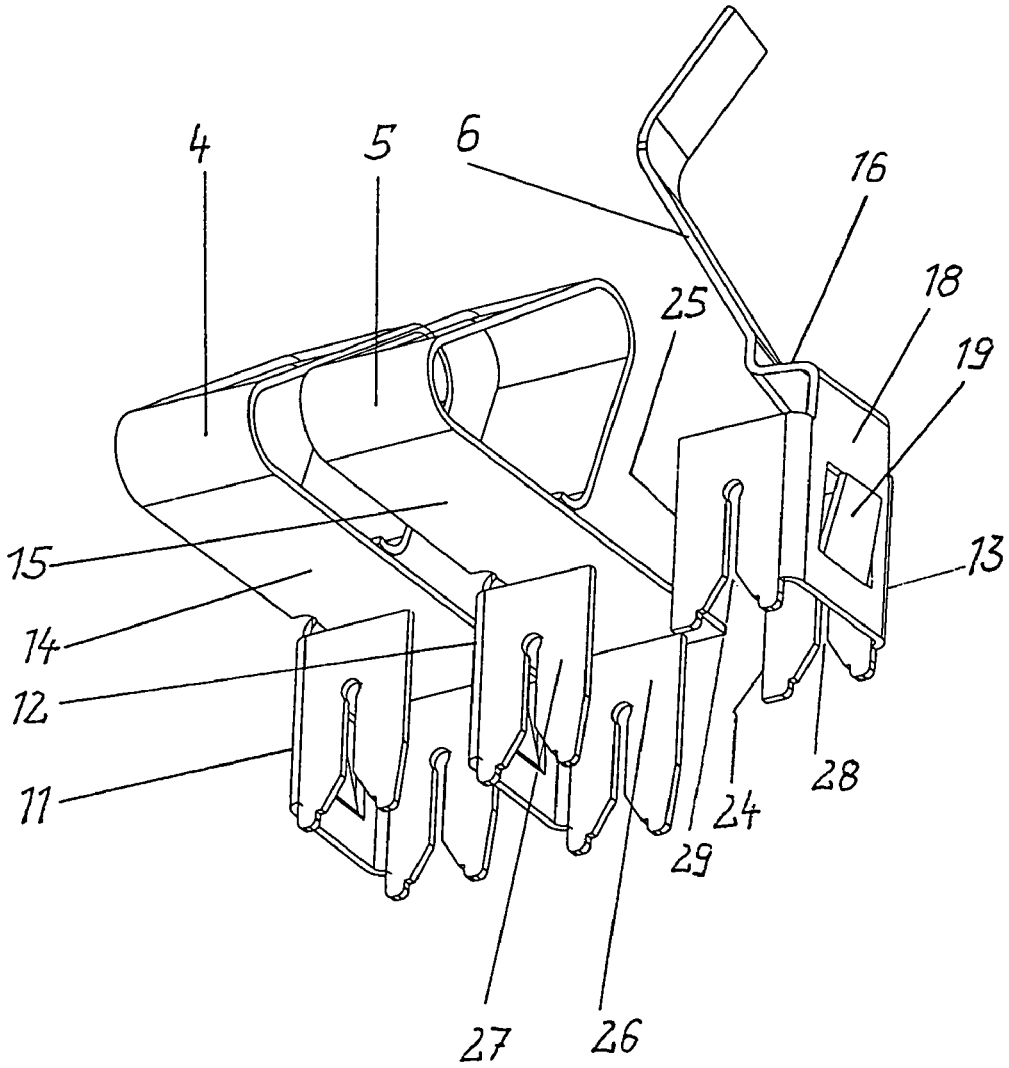
FIG. 4 is an isometric view of a rear side of contact springs of the bulb socket of FIG. 1.

A bulb socket has a socket body 1, that is formed from a cylindrically-shaped part 2 and a plate 3 supporting contact springs 4, 5 and 6, with the plate 3 being inset deeply in the cylindrically-shaped part 2 from a rear end thereof. In the depicted embodiment, a connection of the plate 3 with the cylindrically-shaped part 2 is achieved by flexibly yielding small arms 7 on the plate 3 whose snap cams 8 automatically index, or snap, into corresponding cavities, or indentations, of the cylindrically-shaped part 2. This connection can also be achieved by welding, adhesive and/or combinations including these.

An attachment of the socket body 1 in a receiving part, for example in a reflector, is accomplished by a outer flange 9 that is arranged in a middle area of the cylindrically-shaped part 2 and a front, adjacent, radially protruding cam lobe 10 that together form a sliding bayonet catch lock.

The contact springs 4, 5, 6 are U-shaped in cross section (a section taken parallel to flange 9) at their rear end portions directed away from a light bulb toward a rear end of the socket body, so that they can be shoved from a light-bulb side of the plate through similar U-shaped openings in the plate 3 until surfaces of flat portions 14, 15, 16 lie on a front plate surface 17. In this position, a spring tongue 19 bent in a cross web 18 of each of the U-shaped portions 11, 12, 13, will grip a rear plate surface, opposite the plate surface 17. In this manner, the contact springs 4, 5, 6 are securely mounted in the plate 3.

In order to provide the contact springs 4, 5, 6 an even better and securer seating in the plate, the rear side of the plate is provided with block-shaped protrusions 20, 21, 22, 23 directed toward the rear end of the socket, that snugly encompass the U-shaped end portions 11, 12, 13 of the contact springs 4, 5, 6. For this purpose, the block-shaped protrusions 21, 22 are provided with grooves into which edges 24, 25 of legs 26, 27 of the U-shape are smoothly slid.

IDC Insulation-displacing, or piercing, slits 28, 29 defined by edges for IDC connections, or bonds, with cables 30, 31, 32 are formed in the legs 26, 27 of the cross-sectional U-shaped end portions 11, 12, 13 of the contact springs 4, 5, 6. To relieve tension on these cables 30, 31, 32 extending perpendicular to the socket body 1, they are squeezed into open slits that are formed in a rear rim portion 33 of the rearward end of the cylindrically-shaped part 2 of the socket body 1.

A bowel space 34, formed by the rear rim portion of the cylindrically-shaped part 2 of the socket body together with the plate 3, can be filled with a bonding agent that serves to ensure a mechanical strength of the IDC insulation piercing clamp connection and to provide a waterproof seal of the socket body 1 on the rear side.

While the invention has been particularly shown and described with reference to a preferred embodiment, it will be understood by those skilled in the art that various changes in form and detail may be made therein without departing from the spirit and scope of the invention.

What is claimed is:

1. A light bulb socket for holding a light bulb of a motor vehicle lamp and making electrical contact with said light bulb, said light bulb socket comprising: a hull shaped socket body of resinous plastic, said socket body including a cylindrically-shaped part and a transverse partition; contact springs for being snap engaged into the partition from a light-bulb side of the partition; wherein the partition is formed separately from said cylindrically-shaped part as a plate for being placed in the cylindrically-shaped part from a rear end of the cylindrically-shaped part directed away from the light bulb after the contact springs are snap engaged therewith; and said light bulb socket further including attachment means for attaching the plate to the cylindrically-shaped part within said cylindrically-shaped part.

2. The light bulb socket of claim 1, wherein the attachment means is for attaching the plate to the cylindrically-shaped part at a position where the plate is substantially spaced from the rear end of the cylindrically-shaped part, deep in the cylindrically-shaped part.

3. The light bulb socket of claim 1 wherein is further included an adhesive agent for filling a space formed by the plate and a rear portion of the cylindrically-shaped part of the socket body.

4. The light bulb socket of claim 1 wherein the cylindrically-shaped part of the socket body has an exterior flange at a middle portion thereof with a cam lobe adjacent thereto for together forming a sliding bayonet catch lock.

5. The light bulb socket of claim 1 wherein the attachment means is an adhesive.

6. The light bulb socket of claim 1 wherein the attachment means is a self-snap-locking mechanism on the partition and the cylindrically-shaped part.

7. The light bulb socket of claim 1 wherein the attachment means is a weld.

8. The light bulb socket of claim 1, wherein the contact springs include means for making insulation-displacement connections to power cables that extend perpendicular to an axis of the cylindrically-shaped part.

9. The light bulb socket of claim 8, wherein a collar-shaped, power-cable-connection-encompassing, rear portion of the cylindrically-shaped part of the socket body has open slits extending to a rear end edge of the cylindrically-shaped part, for receiving and clamping the power cables.

10. The light bulb socket of claim 8, wherein the means for making insulation-displacement connections are insulation-displacement slits and wherein the contact springs have U-shaped cross sections in an area at which they are held in the plate and in an area at which the insulation-displacement slits are located.

11. The light bulb socket of claim 10, wherein a rear side of the plate, opposite said light-bulb side, has block-shaped protrusions extending in a direction of the rear end of the cylindrically-shaped part, said protrusions having grooves therein to receive edges of legs of the cross-sectional U-shaped contact spring portions.

12. The light bulb socket of claim 10, wherein a resilient spring snap tongue is formed from a web of the cross-sectional U-shaped portions of the contact springs.

13. A method of making a light bulb socket for holding and making electric contact with a light bulb of a motor vehicle lamp, said method including: providing a hull shaped socket body of resinous plastic by providing a cylindrically-shaped part and a partition, the partition being formed as a plate separate from said cylindrically-shaped part; sliding contact springs into the plate from a light-bulb side thereof on which said contact springs are to make contact with said light bulb until the contact springs make snap engagement with the plate; thereafter placing the plate into the cylindrically-shaped part from a rear end of the cylindrically-shaped part directed away from the light bulb; and attaching the plate to the cylindrically-shaped part within said cylindrically-shaped part.

* * * * *